US007373859B1

(12) United States Patent
Shirlin et al.

(10) Patent No.: US 7,373,859 B1
(45) Date of Patent: May 20, 2008

(54) ROOF SHINGLE STRIPPING APPARATUS

(76) Inventors: Jack W. Shirlin, P.O. Box 43, Garden City, MI (US) 48136; Robert T. Kaiser, deceased, late of Wayne, MI (US); by Samantha Kaiser, legal representative, 5444 Woodward, Wayne, MI (US) 48184; Klai Y. Shirlin, 31705 Sheridan, Garden City, MI (US) 18135

( * ) Notice: Subject to any disclaimer, the term of this patent is extended or adjusted under 35 U.S.C. 154(b) by 0 days.

(21) Appl. No.: 11/566,308

(22) Filed: Dec. 4, 2006

Related U.S. Application Data

(60) Provisional application No. 60/741,808, filed on Dec. 5, 2005.

(51) Int. Cl.
*E04D 15/00* (2006.01)
*B26B 3/00* (2006.01)

(52) U.S. Cl. ..... 81/45; 30/170

(58) Field of Classification Search ..... 81/45; 30/170; 254/131.5
See application file for complete search history.

(56) References Cited

U.S. PATENT DOCUMENTS

| | | | | | |
|---|---|---|---|---|---|
| RE13,011 | E | * | 8/1909 | Hase | 30/170 |
| 2,326,514 | A | * | 8/1943 | Bard | 299/37.4 |
| 4,477,972 | A | * | 10/1984 | Testa, Jr. | 30/172 |
| 4,663,995 | A | * | 5/1987 | Amundson et al. | 81/45 |
| 4,691,439 | A | * | 9/1987 | Marra | 30/170 |
| 4,709,479 | A | * | 12/1987 | Lavelette | 30/170 |
| 4,756,578 | A | * | 7/1988 | Mims et al. | 299/37.1 |
| 4,763,547 | A | * | 8/1988 | Dike, Jr. | 81/45 |
| 4,858,503 | A | * | 8/1989 | Dike, Jr. | 81/45 |
| 5,001,946 | A | * | 3/1991 | Shirlin et al. | 81/45 |
| 5,076,119 | A | * | 12/1991 | Wenz | 81/45 |
| 5,218,766 | A | * | 6/1993 | Himebaugh | 30/170 |
| 5,741,047 | A | * | 4/1998 | Ordonez | 299/37.1 |
| 5,863,100 | A | * | 1/1999 | Martin | 299/37.1 |
| 5,921,155 | A | * | 7/1999 | Faller et al. | 81/45 |
| 6,105,470 | A | * | 8/2000 | Hutchins | 81/45 |
| 2002/0053261 | A1 | * | 5/2002 | Arturo et al. | 81/45 |
| 2006/0156866 | A1 | * | 7/2006 | Ingell | 81/45 |

* cited by examiner

*Primary Examiner*—Joseph J. Hail, III
*Assistant Examiner*—Bryan R. Muller
(74) *Attorney, Agent, or Firm*—Steven M. Clemmons

(57) ABSTRACT

An apparatus for removing roof shingles includes an elongated body having a handle at its upper end and a lift plate pivotally connected to its lower end. The lift plate includes a removable blade at its leading edge and a roller that parallels the leading edge. The lift plate is linked to a pneumatically powered actuator that causes the lift plate to pivot about the roller upon the activation of a trigger mounted in the handle. The handle both rotates around the body and is movable linearly along the body against a biasing compression spring.

20 Claims, 10 Drawing Sheets

ROOF SHINGLE STRIPPING APPARATUS

CROSS-REFERENCE TO RELATED PATENT APPLICATIONS

This application claims priority to Provisional Application No. 60/741,808, filed Dec. 5, 2005.

FIELD OF THE INVENTION

This invention is related to an apparatus for stripping roof shingles and nails.

BACKGROUND OF THE INVENTION

Roof shingles are difficult to remove from an existing roof. The shingle nails are also very difficult to remove.

Conventionally, roofers employ a shovel-like prying hand tool which is inserted beneath a shingle or nail. The tool is pivoted to raise the shingle and the nails. This is a very difficult and time-consuming process. It is therefore desirable to provide a power operated roof stripping device that eases the labor-intensive task of stripping shingles from a roof.

Some power operated roof striping devices are known in the prior art. These include U.S. Pat. No. 5,001,946 which issued Mar. 26, 1991 to the present inventors; U.S. Pat. No. 4,663,995 which issued May 12, 1987 to Frank M. Amundson; Herbert C. Manners; and Paul M. Jeffries; and U.S. Pat. No. 4,763,547 which issued Aug. 16, 1988 to John H. Dike, Jr.

In our previous invention disclosed in U.S. Pat. No. 5,001,946 we described a pneumatic lifting/prying tool that, while fully capable of stripping shingles off of a roof, suffered from several drawbacks. One of these drawbacks is that when the device was used, the stripped shingles would continue past the lifting blade and fall back down onto the newly stripped roof section. This results in the user having to clear away these stripped shingles to reach the next section of shingles and may result in the user getting injured by either tripping over the stripped shingles or by stepping on a removed nail. Another drawback is that the device is relatively heavy and must be carried by a user around the rooftop. Further, the pivot point on the bottom the lifting plate wears down during repeated use.

Therefore, there is a need for an improved roof shingle stripping apparatus that overcomes these and other drawbacks.

SUMMARY OF THE INVENTION

The broad purpose of the present invention is to provide an improved power-operated, roof stripping apparatus. The preferred embodiment of the invention, which will be described in greater detail, comprises an elongated body having a handle at its upper end and a lift plate pivotally connected to its lower end. The lift plate has at least one roller mounted beneath the pivotal connection to the body, generally parallel to the leading edge of the lift plate. The leading or forward edge is coupled to a removable blade that is inserted beneath a shingle or a nail for raising it. A curved shield is mounted atop the lift plate and directs removed shingles away from the upper end of the body.

The arrangement is such that after inserting the lift plate and blade beneath a shingle, the user can manually raise the shingle either by swinging the handle about the roller, or triggering a piston and cylinder actuator to pivot the lift plate about the roller, or, a combination of both efforts. The piston and cylinder actuator is connected by a toggle linkage to the rear edge of the lift plate.

The roller, beyond operating as a fulcrum when the apparatus is used to strip shingles allows a user to roll the apparatus from location to location. Having a roller as the fulcrum also reduces wear on the underside of the apparatus.

The handle improves user comfort by rotating about the end of the elongated body to reduce torque forces from being transmitted to the user as well as allowing a user to hold the handle in a position that is comfortable. A cushioning spring allows the handle to translate along the body and reduces impact forces transmitted through the lifting head to the user.

Still further objects and advantages of the invention will become readily apparent to those skilled in the art to which the invention pertains upon reference to the following detailed description.

BRIEF DESCRIPTION OF THE DRAWINGS

The description refers to the accompanying drawings in which like reference characters refer to like parts throughout the several views, and in which.

DETAILED DESCRIPTION OF THE INVENTION

Figure 1:
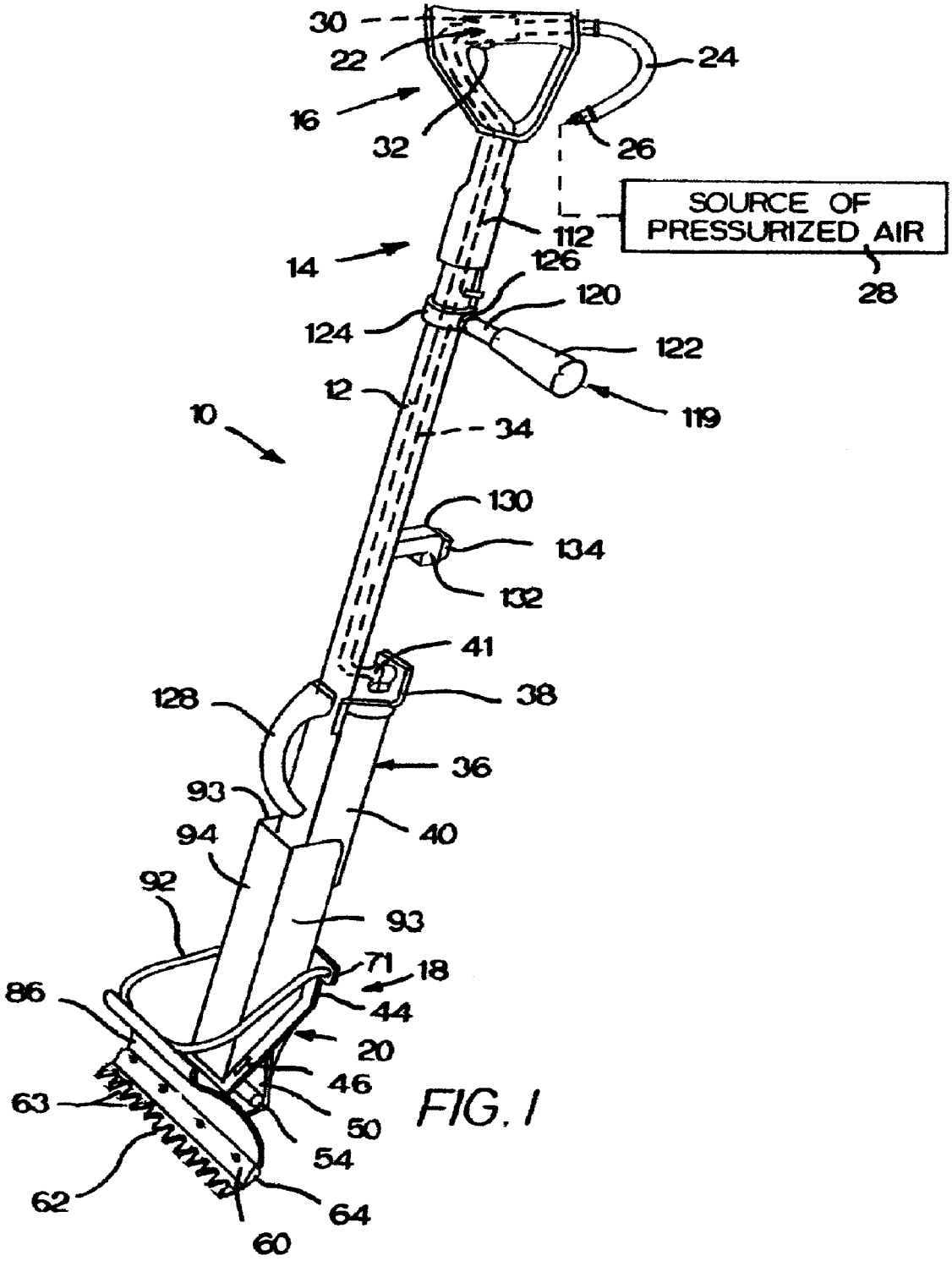
FIG. 1 is a perspective view of a shingle stripping apparatus illustrating the preferred embodiment of the invention.

Referring to the drawings, FIG. 1 illustrates a roof shingle stripping apparatus 10. Apparatus 10 includes an elongated tubular body 12 having its upper end 14 terminating at a handle 16. Its lower end 18 is pivotally coupled to a shingle lifting head 20.

Handle 16 includes a trigger assembly 22 that is connected by a conduit 24 and fitting 26 to a source of pressurized air 28. Conduit 24 is connected a conventional trigger assembly 22 having a pneumatic valve 30 and a trigger 32 for opening and closing communication with source 28. A conduit 34 is connected to the outlet of valve 30 and is disposed inside handle 16 and tubular body 12 as is illustrated in phantom.

A piston and cylinder actuator 36 is mounted by a pair of brackets 38 (one bracket not shown) to the underside of body 12. The cylinder 40 of the actuator is parallel to the length of the body. The lower end of conduit 34 is connected by a fitting 41 to the upper end of the actuator. The actuator has an internal piston (not shown) connected to a piston rod 42 in such a manner that when trigger 32 is squeezed by the user, the piston rod is extended from the cylinder. When the trigger is released, the piston rod is retracted as the pressurized air is exhausted from the cylinder, preferably through fitting 41 to the ambient.

Referring now to FIGS. 2-4 and 7, lift head 20 includes a generally flat lift plate 44. Lift plate 44 has a pair of spaced lugs 46. A pivot pin 48 pivotally connects the lower end of body 12 to lugs 46. The lift plate is formed from heavy-gauge plate-like steel.

A roller housing 50 is coupled to the bottom surface 52 of the forward portion of lift plate 44. Housing 50 is generally triangular in shape and rotatably retains a cylindrical roller 54 within the apex of the triangle (i.e., at its furthest point from surface 52). Roller 54 is preferably centered relative to cylinder 20 and body 12 and has a rotational axis that is generally parallel to lift plate pivot pin 48. Roller housing 50 is located upon surface 52 such that roller 54 is in a location between pivot pin 48 and the leading edge. As will be described in greater detail below, roller 54 operates as a fulcrum to strip shingles and roofing nails from a roof.

Support ribs 56 provide additional rearward support to the triangular housing 50.

Lift plate 44 preferably has a front edge 58 about 8-10 inches wide forming an edge that is generally parallel to the axis of rotation of body 12 with respect to the lift plate. Pivot pin 48 is mounted about 5 inches behind the lift plate's front edge.

Mounted to lift plate 44 across front edge 58 is a shingle-engaging blade 60. Blade 60 is a generally rectangular plate that is removably coupled to lift plate 44 by conventional fasteners 61. Blade 60 extends from front edge 58 generally parallel to the frontward portion of lift plate 44. The forward or leading edge 62 of blade 60 has a plurality of open-ended slots 63, each adapted to receive a nail when the lift plate is inserted beneath the nail head. Leading edge 62 and each slot 63 are beveled to assist insertion beneath a shingle.

Figure 2:
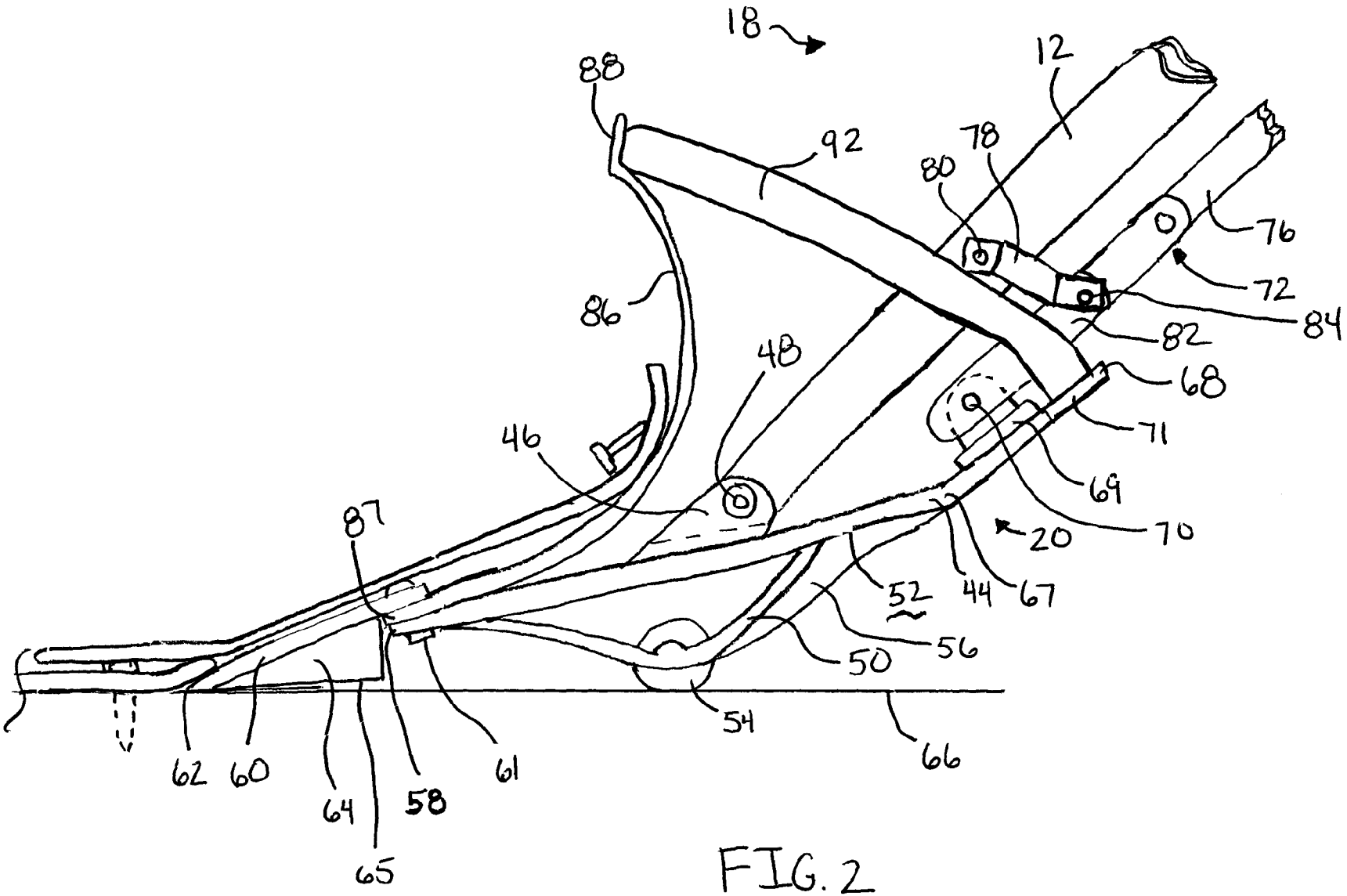
FIG. 2 is a side view of the lower end of the preferred apparatus.
Figure 3:
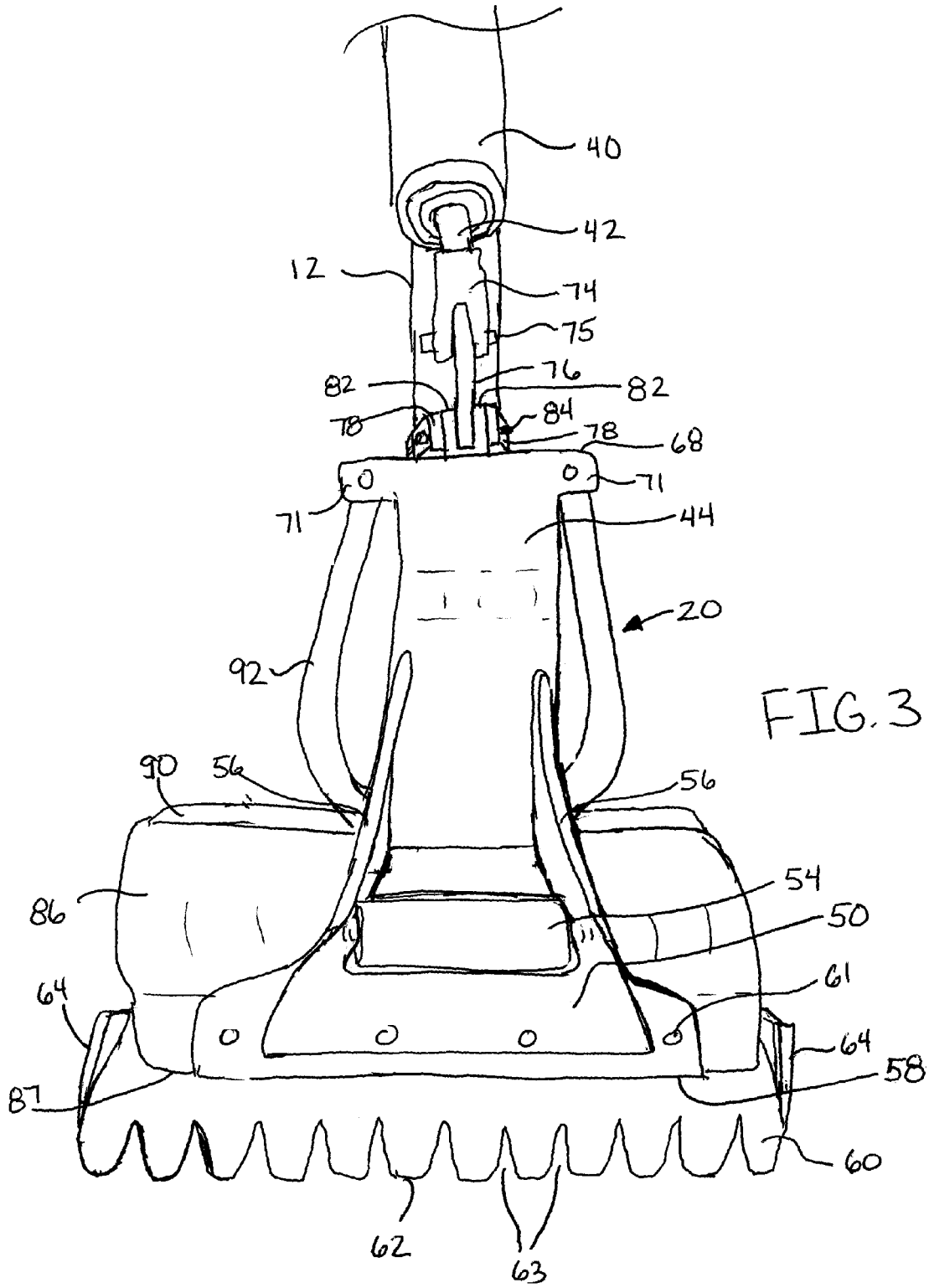
FIG. 3 is a bottom view of the lower end of the preferred apparatus.
Figure 4:
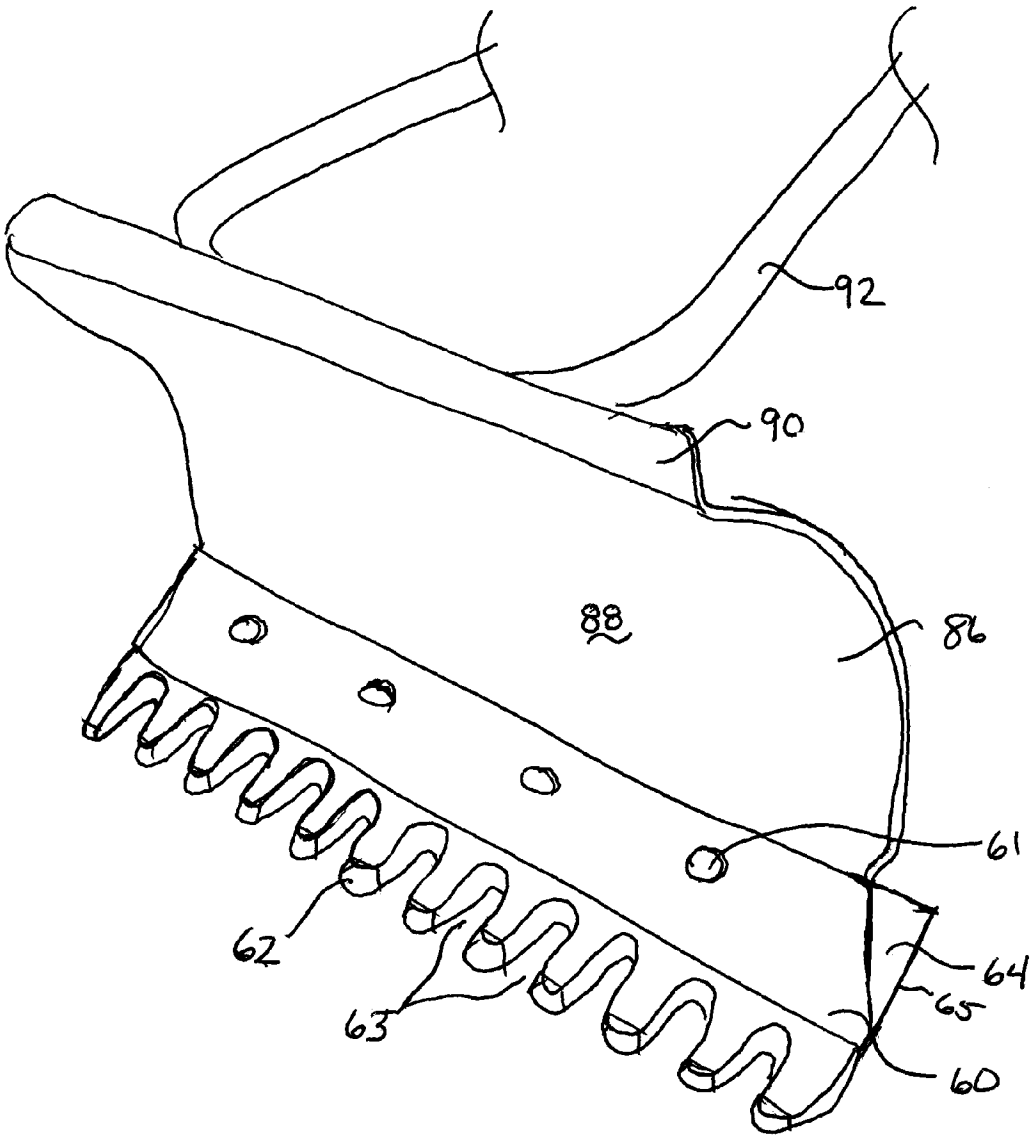
FIG. 4 is a partial perspective view of the shingle-engaging portions of the lift head.

It should be appreciated, and as best shown in FIG. 2, the roller housing 50 and leading edge 62 of the blade are normally the only surfaces that engage the roof.

A side skirt 64 extends downward from the side ends of blade 60. Side skirt 64 has a lower edge 65 that abuts the roof 66 to prevent the apparatus 10 from tipping over the centrally located roller 54. For example, if a nail is lifted with one of the outer slots 63, the apparatus 10 may attempt to roll, generally about the axis of body 12, toward the opposite side of the blade. The side skirt on this opposite side of the blade engages the roof to support the apparatus and prevent this roll-over.

The lift plate is bent at 67 to form a rear edge 68. An upwardly facing flange or boss 69 having a pivot pin 70 is mounted on rear edge 68. A pair of side flanges 71 extend from the opposite sides of rear edge 68.

Figure 5:
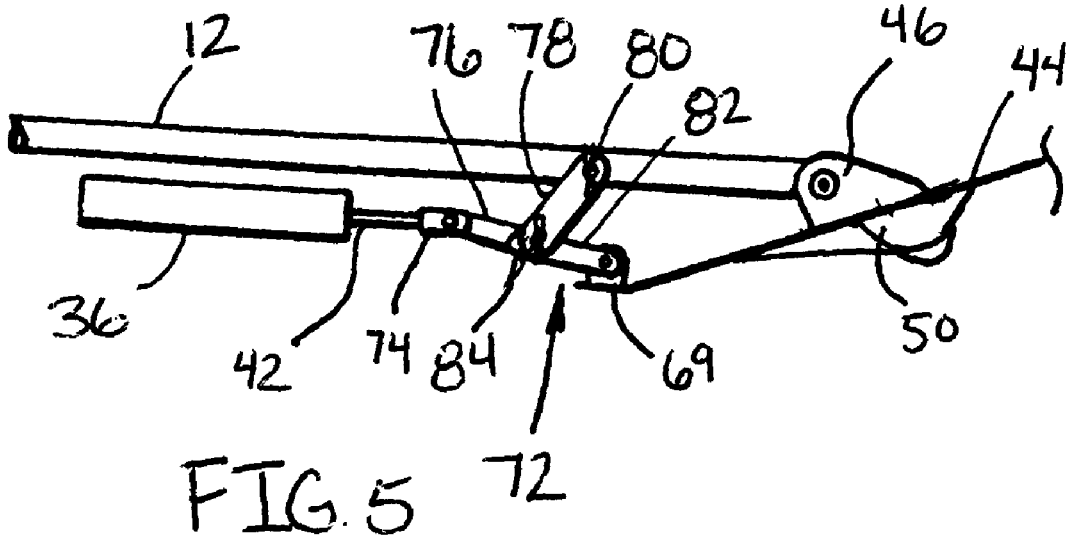
FIGS. 5-6 illustrate the power-operated apparatus and toggle-linkage employed for pivoting the lift plate with respect to the lower end of the body.
Figure 6:
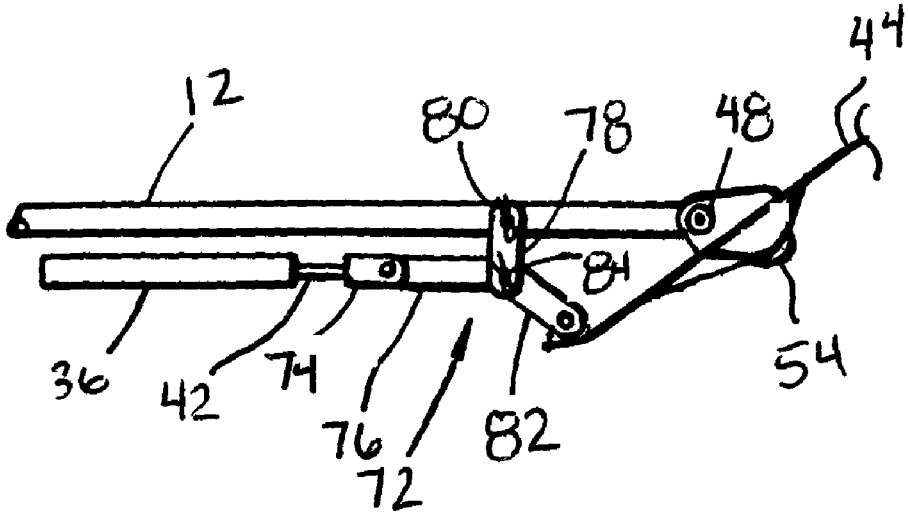

As best illustrated in FIGS. 5 and 6, a toggle linkage 72 is mounted between pivot pin 70 and piston rod 42. Toggle linkage 72 includes a clevis 74 mounted on the end of the piston rod. A pin 75 pivotally connects the clevis to a link 76. A pair of link means 78 are connected by pin means 80 to body 12. A pair of link means 82 are mounted on pivot pin 70. Pivot means 84 connect the ends of link 76, link means 78 and link means 82 together in such a manner that as the piston rod is extended, link 76 pushes link means 78 with respect to link means 82 so that they unfold to pivot the rear edge of the lift plate away from body 12. When the piston rod is retracted, link 76 pulls link means 78 and 82 so as to slightly fold link means 78 with respect to link means 82 together to move the rear edge of the lift plate toward the body.

A shingle or a nail may be lifted by inserting the leading edge of the blade beneath the shingle or other roofing structure, squeezing the trigger to actuate the cylinder and thereby cause the toggle linkage to unfold and apply a substantial lifting force about the roller on the leading edge of the blade.

Figure 7:
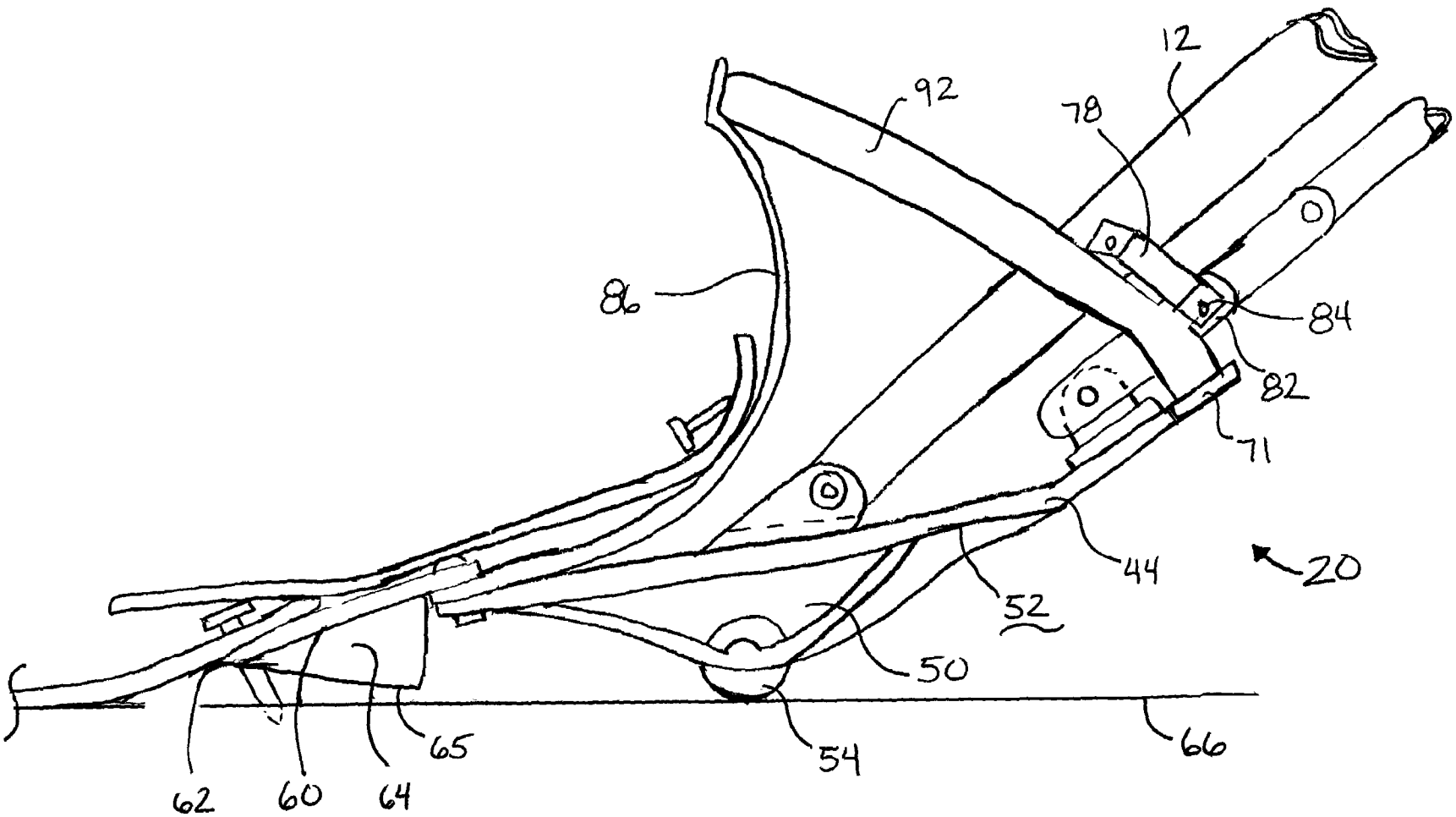
FIG. 7 is a view similar to FIG. 2 but in which the nail has been raised.

Lift head 20 also includes a curved shingle guide scoop 86. Scoop 86 is a curved plate that is mounted at its front edge 87 between the upper surface of lift plate 44 and blade 60. Scoop 86 has the same approximate width as blade 60 and presents a concave shovel-like surface 88 facing the leading edge the blade. The rear edge 90 of the scoop flattens out and is coupled to a U-shaped brace 92 that is mounted to flanges 71 of the lift plate. As illustrated in FIG. 7, scoop 86 operates to deflect any lifted shingles and roofing nails back in the direction of the leading edge and away from body 12 and the user. It should be appreciated that if the apparatus is used on an angled rooftop, the scoop would direct the lifted roofing materials down the slope of the roof when a user starts stripping the roof down from its peak.

A sheet metal linkage cover or shield 94 having a generally U-shaped cross-section is removably coupled to body 12. Shield 94 is wrapped around body 12 and overhangs on its two sides 93 to provide additional protection to the pivot means and links found in linkage 72 from any debris or other material that may pass beyond shingle guide scoop 86. The forward end of shield 94 is preferably angled to accommodate the curved scoop and the angled relationship between lift plate 44 and body 12.

Figure 8:
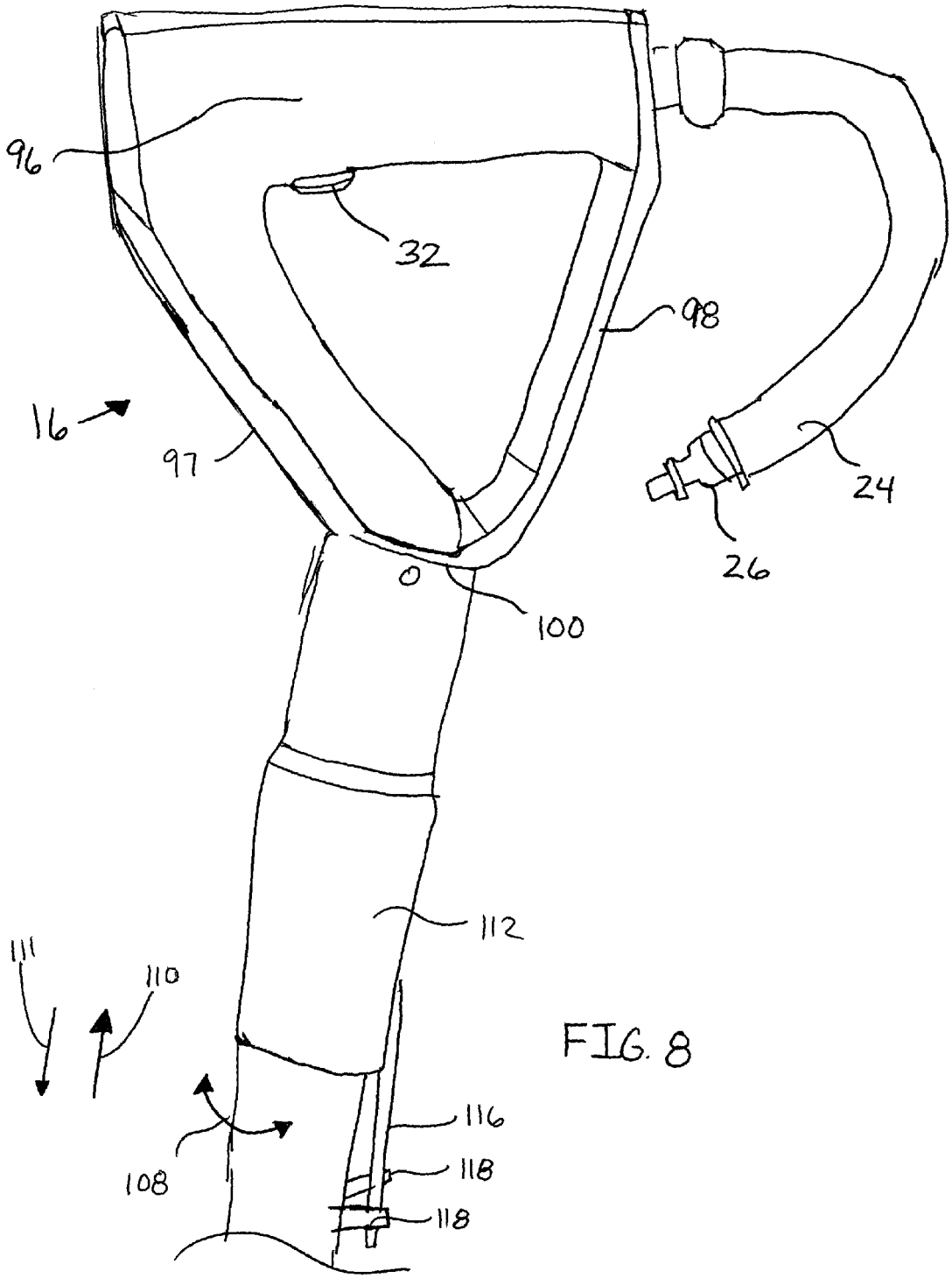
FIG. 8 is a side view of the upper end of the preferred apparatus.
Figure 9:
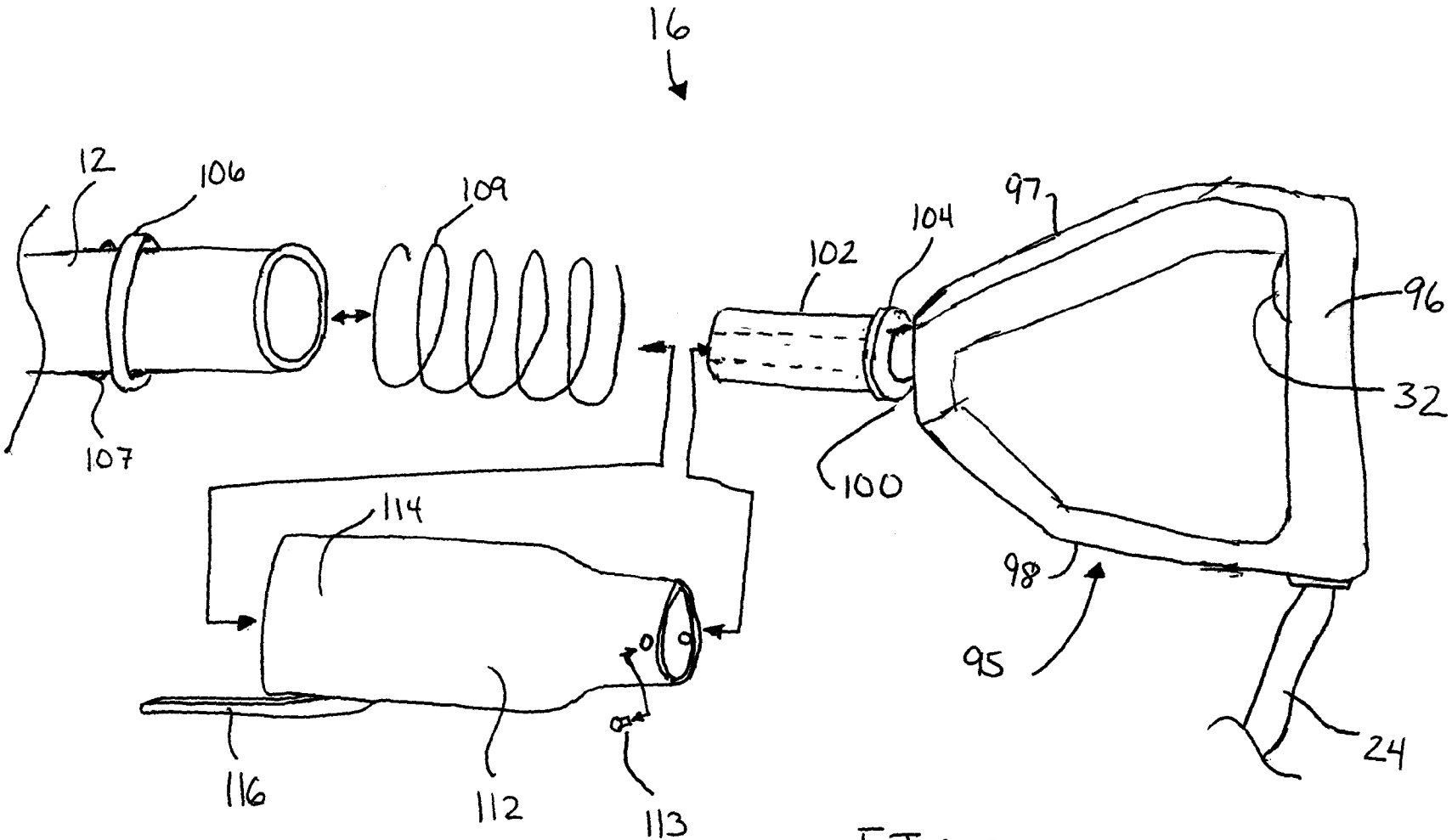
FIG. 9 is a partial exploded view of the upper end of the preferred apparatus.

Referring now to FIGS. 1, 8, and 9, handle 16 is coupled to the upper end 14 of body 12. Handle 16 includes a user hand-engaging portion 95 that is rotatably coupled to upper end 14 of body 12. Portion 95 preferably includes a hand grip 96 that cooperates with two hand guards 97, 98 to define an enclosed, generally D-shaped, handle. Trigger 32 passes through the inner wall of grip 96 to allow a user to activate actuator 36. The upper hand guard 97 includes an internal chase (not shown) that allows conduit 34 to pass therethrough.

The two hand guards or straps 97, 98 come together at a front face 100 of portion 95. A tubular shaft 102 projects from front face 100. A bushing 104 is slidably fit over shaft 102 adjacent to face 100. The outer surface of bushing 104 is sized complementary to the inner diameter of body 12. A second bushing 106 is located around body 12 and abuts bosses 107 that project radially from the outer surface of body 12. Bosses 107 are preferably rivets punched into the tubular body a distance from the forward end that is slightly deeper along the body than the length of handle shaft 102. Bosses 107 prevent bushing 106 from sliding down the body toward forward end 18. In the preferred embodiment busing 106 is a washer formed from low-friction material, such as PTFE.

Bushings 104, 106 cooperate to allow the hand-engaging portion 95 to rotate out the longitudinal axis of body 12 in the directions shown by arrow 108.

Handle 16 also includes a compression spring 109 that is disposed between bushings 104, 106 and is sized to fit around body 12. When assembled, spring 109 biases portion 95 in the direction of arrow 110 while allowing portion 95 to deflect along the body in the direction of arrow 111 to cushion any forces transmitted from the operation of the apparatus to the user.

A tubular cover 112 is preferably fixed to the forward end of portion 95 by conventional fasteners, such as rivets 113. Cover 112 includes a forward portion 114 that is sized to fit over spring 109 and the outer diameter of the body 12. By fixedly coupling cover 112 to portion 95, cover 112 rotates with portion 95 relative to body 12. To prevent portion 95 from rotating to far and potentially damaging the internal conduit 34, cover 112 includes a stop arm 116 that extends away from forward portion 114 parallel to body 12. A pair of studs 118 that extend from body 12 cooperate with arm 116 to restrict movement in the directions of arrow 108.

Referring back to FIG. 1, apparatus 10 further preferably includes a second handle 119. Handle 119 includes a cylindrical shaft 120 that terminates in a concentrically disposed cushioned grip 122. An annular ring 124 is removably and repositionably coupled along body 12 and includes a clevis 126. Shaft 120 is pinned within clevis 126 such that shaft 120 and grip 122 extend perpendicularly from body 12. In the preferred embodiment, the clevis mating end of shaft 120 is pinned to allow the shaft and grip to move slightly in the direction of the body. In another embodiment, grip 122 is mounted to shaft 120 in a manner that allows that grip to rotate about the shaft. In another embodiment studs 118 extend from annular ring 124.

Apparatus 10 also includes a carrying handle 128 mounted to the body 12 above the shield 94. Carrying handle 128 is preferably mounted proximate to the center-of-mass of the apparatus to facilitate carrying the shingle stripping apparatus.

In the preferred embodiment of the invention, a sliding brake or hook 130 extends from the underside of body 12 (i.e., on the same side as roller 54 and actuator 36). Brake 130 is an generally L-shaped bracket that extends perpendicularly from body 12 beyond actuator 36 and is operative to protect the actuator in the event the apparatus is dropped. Brake 130 includes a forward facing leg 132 that operates as a hook to resist sliding movement if the apparatus is left unattended on an a rooftop. To further reduce the chance of the apparatus rolling or sliding down a roof and to pad the apparatus if the handle is dropped, an elastomeric or rubber pad 134 is mounted to the bottom end of 132.

Figure 10:
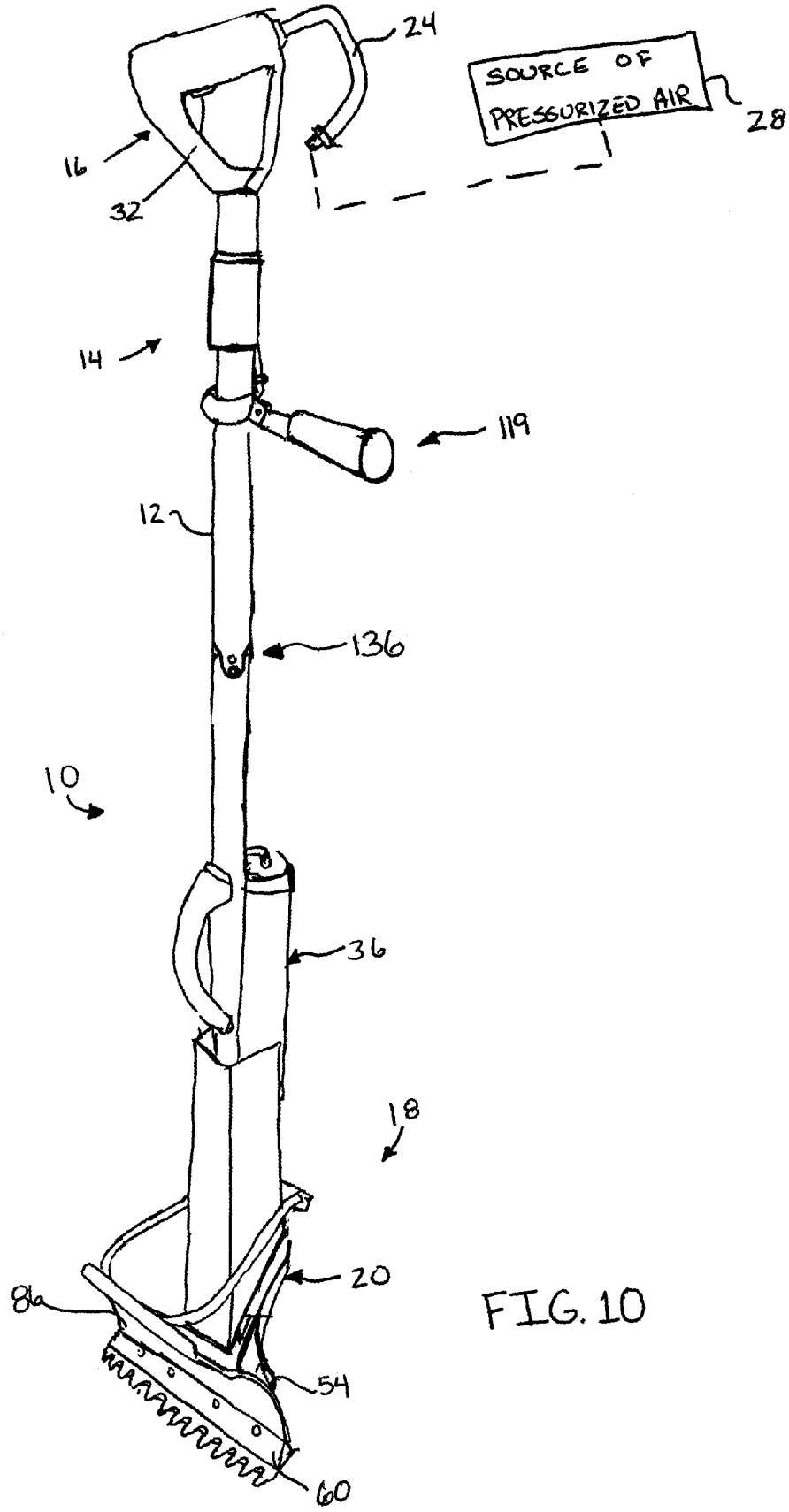
FIG. 10 is a perspective view of the shingle stripping apparatus having a pivoting elongated body.
Figure 11:
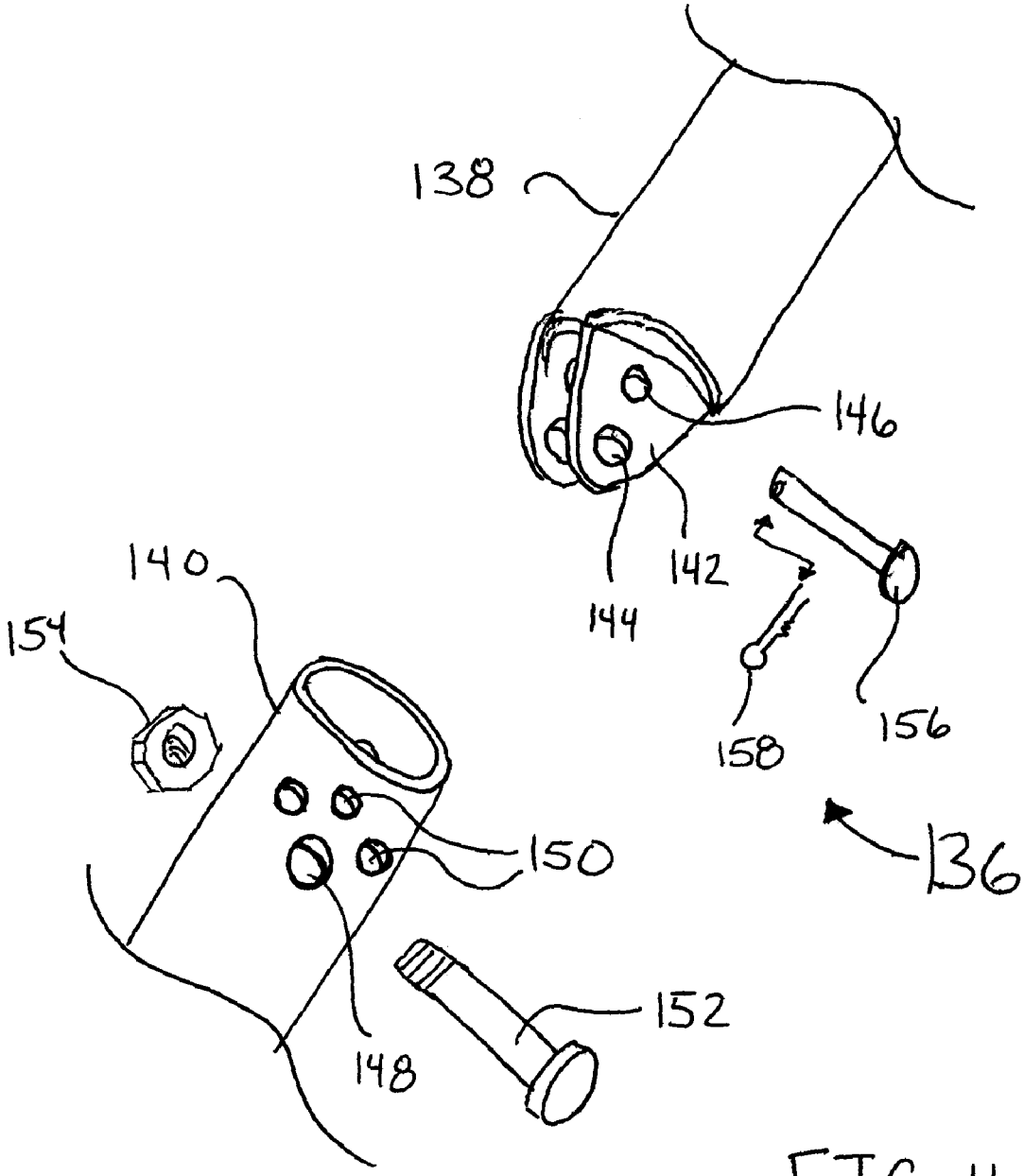
FIG. 11 is a exploded partial view of the pivoting portion of the shingle stripping apparatus illustrated in FIG. 10.

Referring now to FIGS. 10 and 11, a shingle stripping apparatus 10 is shown including a pivoting or articulated section 136 along elongated body 12. Pivoting section 136 is formed from elongated body 12 being severed in the approximate center along its length. The two severed ends 138, 140 are pivotally coupled together to allow the upper end 14 to be angled relative to lower end 18 and lift head 20.

End 138 terminates in a clevis 142 formed from two parallel flanges that extend down and away from opposite sides of the end. Clevis 142 is spaced to receive end 140 and includes a pivot pin bore 144 and a lock pin bore 146 formed through the clevis.

End 140 includes a pivot pin bore 148 formed through the generally cylindrical body and three lock pin bores 150 that are radially spaced about bore 148.

When pivot portion 136 is assembled body pivot pin 152 is inserted through one of the clevis' pivot bores 144 and into pivot bore 148 formed in end 140 and then through the other clevis pivot bore. A mechanical fastener, such as nut 154 is threaded onto the end of pin 152 to hold pivot portion 136 together.

A lock pin 156 is selectively disposed through clevis bores 146 and one of the three angle adjustment bores 150 to position and hold the upper end 14 at an angle relative to lower end 18. A temporary retainer, such as cotter pin 158, holds lock pin 156 in position.

Clevis 142 and its bores 144, 146 are positioned on end 138 such that body pivot pin 152 and lock pin 156 are both parallel to roller 54 and leading edge 62 when passed through complementary bores 144, 148 and 146, 150.

In the preferred embodiment, one of the lock pin bores 150 is aligned with pivot bore 148 to cause the pivot portion 136 to take no angle thereby resulting in the entire body 12 to be substantially straight. It should be appreciated that any number of lock pin bores 150 may be used to allow various angles to be selected and that other pivoting assemblies may be used to allow upper end 14 to angle away from lower end 18.

The invention has been described in an illustrative manner, and it is to be understood that the terminology, which has been used, is intended to be in the nature of words of description rather than of limitation. Further, many modifications and variations of the present invention are possible in light of the above teachings. It is, therefore, to be understood that within the scope of the appended claims, the invention may be practiced other than as specifically described.

Having described our invention, we claim:

1. A roof shingle stripping device for removing a shingle from a roof, comprising:

an elongated body having an upper end and a lower end;

a handle coupled to the upper end of the body;

a lift plate pivotally coupled to the lower end of the body at a pivot pin, said lift plate having a generally flat bottom surface, a front edge, and a trailing edge;

a roller that is rotatably mounted within a triangular housing fixed to the bottom surface of the lift plate between the front edge and pivot pin, the roller extends only partially out of said housing to engage said roof and rotates about an axis that is parallel to the leading edge;

a blade having an open-end slot for receiving a roofing nail, said blade is removably coupled to and covers the front edge of the lift plate;

a brake means coupled to the body above the lower end and operative to frictionally grip the roof to prevent the stripping apparatus from sliding off the roof;

shingle guide means that is coupled to a top surface of the lift plate and is operative to direct raised shingles back toward the general direction of the front edge and away from the upper end of the body; and a powered actuator mounted to the body, said actuator including a linkage pivotally connected between the body and the lift plate, such that the actuator is operative to selectively cause said lift plate to pivot about said roller with respect to the body to raise the shingle from the roof.

2. A roof shingle stripping device as defined in claim 1, wherein said handle comprises:

a hand-grip that is coupled at a top and bottom end to a pair of handle straps, said hand-grip including means operative to energize the powered actuator; and means that rotatably couples the hand-grip to the body and is operative to allow the hand-grip to rotate about a longitudinal axis of the body.

3. A roof shingle stripping device as defined in claim 2, wherein said handle further comprises means disposed within the upper end of the body and is operative to cushion compressive forces between the handle and the body along the longitudinal axis of the body.

4. A roof shingle stripping device as defined in claim 2, wherein said handle further comprises stop means that extends from the handle and cooperates with a flange projecting from the upper end of the body to form an abutment that limits the rotational movement of the handle about the body.

5. A roof shingle stripping device as defined in claim 1, including an elongated secondary handle comprising a cylindrical shaft that is removably coupled to and extends perpendicularly from the body between the upper end and the lower end.

6. A roof shingle stripping device as defined in claim 1, in which the blade includes a pair of side support skirts that extend from the outer side edges of the blade.

7. A roof shingle stripping device as defined in claim 1, wherein the elongated body includes angle adjustment means disposed between the upper and lower end and is operative to allow the upper end to be angled away from a longitudinal axis of the lower end of the body.

8. A roof shingle stripping device as defined in claim 1, wherein said roller is rotatably mounted within an apex of said triangular housing.

9. A roof shingle stripping device as defined in claim 1, further comprising a support rib along a trailing surface of said triangular housing and attached to said flat bottom surface.

10. A roof shingle stripping device as defined in claim 1, wherein said brake means comprises a hook with an elastomeric pad mounted to the bottom end thereof.

11. An improved roof shingle stripping apparatus of the type wherein a lift plate having a forward edge is pivotally coupled to a bottom end of an elongated body, and wherein a powered actuator mounted to the body is coupled by a linkage to the body and to the lift plate such that the lift plate is pivoted with respect to the body when the actuator is operated to raise a shingle from a roof, wherein the improvement comprises:

a roller rotatably mounted within a triangular housing fixed to a bottom surface of the lift plate, wherein said roller extends only partially out of said housing to engage said roof and rotates about an axis that is parallel to the forward edge;

a brake means coupled to the body above the lower end and operative to frictionally grip the roof to prevent the stripping apparatus from sliding off the roof; and a shield coupled to a top surface of the lift plate, said shield is curved to form a concave surface facing the forward edge.

12. The improvement as defined in claim 11, including a lifting blade that is removably coupled to and covers the forward edge, the lifting blade has a front edge that is beveled and includes a plurality of open-end slots for receiving a roofing nail.

13. The improvement as defined in claim 12, in which the lifting blade also includes side support means coupled to the outer side edges of the blade and is operative to abut the roof to prevent the stripping apparatus from tipping over laterally when the shingle is raised.

14. The improvement as defined in claim 12, including a handle that is coupled to an upper end of the body, the handle includes means for rotating the handle about a longitudinal axis of the body.

15. The improvement as defined in claim 14, wherein said handle also includes a compression spring fixed within the upper end of the body and is biased against the handle in a direction parallel to a longitudinal axis of the body.

16. The improvement as defined in claim 12, including a handle that is coupled to an upper end of the body, the handle includes a compression spring fixed within the upper end of the body and is biased against the handle in a direction parallel to a longitudinal axis of the body.

17. The improvement as defined in claim 12, including a carrying handle coupled to the body, wherein the carrying handle is disposed proximate to the center-of-mass of the stripping apparatus.

18. The improvement as defined in claim 11, wherein said brake means comprises a hook with an elastomeric pad mounted to the bottom end thereof.

19. The improvement as defined in claim 11, including a U-shaped bracket that is coupled to a top end of the shield and to the top surface of the lift plate, wherein the bracket straddles the bottom end of the body.

20. The improvement as defined in claim 11, including angle adjustment means disposed along the elongated body and is operative to allow the upper end to be angled away from the remainder of the body.

* * * * *